US007728565B2

(12) United States Patent
Wyatt

(10) Patent No.: US 7,728,565 B2
(45) Date of Patent: Jun. 1, 2010

(54) NON-INVASIVE LOAD CURRENT SENSING IN LOW DROPOUT (LDO) REGULATORS

(75) Inventor: Michael A. Wyatt, Clearwater, FL (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 170 days.

(21) Appl. No.: 11/938,354

(22) Filed: Nov. 12, 2007

(65) Prior Publication Data

US 2009/0121694 A1 May 14, 2009

(51) Int. Cl.
*G05F 1/613* (2006.01)
*G05F 1/575* (2006.01)

(52) U.S. Cl. ..... 323/269; 323/273

(58) Field of Classification Search ..... 323/268, 323/269, 273, 277, 279, 316
See application file for complete search history.

(56) References Cited

U.S. PATENT DOCUMENTS 4,254,372 A 3/1981 Moore, Jr.
5,012,178 A * 4/1991 Weiss et al. ..... 323/269
5,191,278 A 3/1993 Carpenter
6,201,375 B1 3/2001 Larson et al.
6,232,753 B1 * 5/2001 Pasotti et al. ..... 323/267
6,522,111 B2 2/2003 Zadeh et al.
6,614,706 B2 * 9/2003 Feurle ..... 365/226
6,765,374 B1 * 7/2004 Yang et al. ..... 323/280
6,836,095 B2 * 12/2004 Fogg ..... 320/128
6,952,091 B2 10/2005 Bansal
7,102,337 B2 * 9/2006 Wheeler et al. ..... 323/282
7,385,377 B2 * 6/2008 Pisasale et al. ..... 323/267

* cited by examiner

*Primary Examiner*—Gary L Laxton
(74) *Attorney, Agent, or Firm*—RatnerPrestia

(57) ABSTRACT

A low dropout (LDO) voltage regulator includes an output terminal for providing a regulated voltage output to a load, and a plurality of PFETs connected in parallel. Each PFET drains a level of current and the sum of the levels of current are provided as a current output at the output terminal. The LDO voltage regulator also includes a feedback network coupled to the output terminal for providing a voltage feedback signal, and an error amplifier coupled between the plurality of PFETs and the feedback network for sensing a differential voltage. The error amplifier includes an output voltage which is provided to the plurality of PFETs for adjusting the drain of current from each PFET. A summation of the drains of current from each PFET is provided as the current output to regulate the voltage output at the output terminal. Each PFET drains a current level of $I_{O/n}$ and the summation of the drains of current is the current output $I_O$.

12 Claims, 3 Drawing Sheets

NON-INVASIVE LOAD CURRENT SENSING IN LOW DROPOUT (LDO) REGULATORS

FIELD OF THE INVENTION

This invention relates, generally, to voltage regulators. More specifically, this invention relates to low dropout (LDO) regulators providing a regulated voltage output under varying load conditions. The present invention senses a voltage drop without disturbing the output load condition.

BACKGROUND OF THE INVENTION

A linear voltage regulator accepts a poorly specified and sometimes fluctuating input voltage and provides a substantially constant output voltage at a desirable level. The output voltage is used as a supply voltage for other circuits and is substantially independent of an output current (i.e., a load current). The load current level may vary over time with substantially instantaneous transitions from one level to another level.

For example, the linear voltage regulator supplies power to one or more digital circuits within a computer system which may be on or off depending on processing requirements. Thus, the load current level may be relatively high in one clock cycle and relatively low in a following clock cycle. As the digital circuits continue to improve and operate at higher frequencies, the transitions between clock cycles become faster, thereby decreasing the transition time between load current levels.

One example of an LDO regulator is disclosed in U.S. Pat. No. 6,952,091, issued on Oct. 4, 2005. According to this patent, a series resistor ($R_s$) is inserted in the output current path to sense the output current ($I_o$), as shown in FIG. 1. The voltage drop across this sense resistance ($R_s$) is proportional to the output current ($I_o$) of the regulator, which is fed back to a current limiting circuit. The current limiting circuit controls the drive to the gate of the output transistor ($Q_o$) to limit the current. This arrangement suffers, however, from the drawback that the sense resistor causes a voltage drop leading to an undesired increase in voltage dropout.

Another example of an LDO regulator is disclosed in U.S. Pat. No. 5,191,278, issued on Mar. 2, 1993. Referring to FIG. 2, which is described in that patent, there is shown an LDO linear regulator that maintains a constant output voltage Vout at point 100, regardless of the magnitude of load 110. Power source 120, which provides the input voltage Vin, may be any type of power supply as currently known in the art.

The LDO regulator provides two feedback voltages to summer 130. The current sense and feedback loop, represented by block 140, provides as its output a voltage Vi directly proportional to the current being drawn by load 110. The second input to summer 130 comes from a voltage sense and feedback loop, represented by block 150. Block 150 provides a voltage directly proportional to the difference between Vout and a fixed reference voltage. The output from summer 130 gates pass device 160, which essentially provides a resistance inversely proportional to the voltage applied at its gate. The net result is that when either or both of the current feedback and voltage feedback inputs to summer 130 increases, the voltage out of summer 130 increases and the resistance through pass device 160 decreases, thereby allowing an increased flow of current through the pass device which keeps Vout at its desired level.

The present invention, which is described below, provides an improved LDO regulator, characterized by its ability to regulate the output voltage by using a differential sense amplifier to measure a small change in the output voltage. Furthermore, as described below, the present invention does not require a sense resistor, placed in series with the output load, to sense the output current. In conventional LDO regulators, as shown in FIG. 1, a sense resistor is inserted in series with the output current path to sense the output current. Such conventional arrangement suffers from a drawback that the sense resistor causes a voltage drop leading to an undesired increase in voltage dropout.

SUMMARY OF THE INVENTION

To meet this and other needs, and in view of its purposes, the present invention provides a low dropout (LDO) voltage regulator including (1) an output terminal for providing a regulated voltage output to a load, (2) a plurality of PFETs connected in parallel, wherein each PFET drains a level of current and the sum of the levels of current are provided as a current output at the output terminal, (3) a feedback network coupled to the output terminal for providing a voltage feedback signal, and (4) an error amplifier coupled between the plurality of PFETs and the feedback network for sensing a differential voltage. The differential voltage is provided to the plurality of PFETs for adjusting the drain of current from each PFET. A summation of the drains of current from each PFET is provided as the current output to regulate the voltage output at the output terminal.

The plurality of PFETs include n PFETs, n being an integer greater than 1. Each of the n PFETs includes a source connected to a primary voltage, a gate connected to an output terminal of the error amplifier, and a drain connected to the output terminal. Each PFET drains a current level of $I_{0/n}$ and the summation of the drains of current is $I_0$. The feedback network includes a voltage divider comprising resistors coupled to the output terminal. The error amplifier includes an inverting input and a non-inverting input. The non-inverting input is connected to the feedback network and the inverting input is connected to a reference voltage.

Another embodiment of the invention is an LDO voltage regulator including (1) an output terminal for providing a regulated voltage output to a load, (2) a plurality of PFETs connected in parallel, wherein each PFET drains a level of current and the sum of levels of current are provided as a current output at the output terminal, (3) a sensing network connected to the plurality of PFETs for sensing the level of current drained by each of the plurality of PFETs, and (4) an error amplifier coupled between the output terminal and the sensing network for providing a voltage differential to the sensing network. A summation of the drains of current from each PFET is provided as the current output to regulate the voltage output at the output terminal. The sensing network senses the level of current drained by each PFET of the plurality of PFETs, and provides the sensed level of current as an output control signal.

Each of the n PFETs includes a source connected to a primary voltage, a gate connected to all other gates of the n PFETs, and a drain connected to the output terminal. The sensing network includes a PFET, the PFET being separate from the plurality of PFETs, where the PFET provides the same level of current as each PFET of the plurality of PFETs. The PFET of the sensing network includes a gate connected to all the gates of the PFETs of the plurality of PFETs, a source connected to the primary voltage and a drain connected to an inverting input terminal of an error amplifier. A non-inverting input terminal of the error amplifier is connected to the output terminal. The sensing network includes a cascode PFET having a gate connected to an output terminal of the error amplifier, a source connected to the drain of the PFET of the sensing network, and a drain providing the sensed level of current as the output control signal. The inverting input terminal of the error amplifier and the drain of the PFET of the sensing amplifier is set at approximately a voltage level corresponding to the regulated voltage output. The sensed level of current is approximately at a level of current, which is the same as a level of current in the drain of each PFET of the plurality of PFETs. The output current level is $I_0$ and the drain of each PFET of the plurality of PFETs has a current level of $I_{0/n}$, and the sensed level of current is approximately $I_{0/n}$.

It is understood that the foregoing general description and the following detailed description are exemplary, but are not restrictive, of the invention.

BRIEF DESCRIPTION OF THE FIGURES

The invention is best understood from the following detailed description when read in connection with the accompanying figures.

DETAILED DESCRIPTION OF THE INVENTION

As will be explained, by referring to FIGS. 3, 4 and 5, the present invention includes an LDO regulator that advantageously senses its output load current without disturbing its output voltage. Whereas conventional LDO regulators require a sense resistor (for example, FIG. 4), inserted in series with the output load, to measure load current, the present invention provides a non-invasive load current sensor which does not affect the output load.

Figure 1:
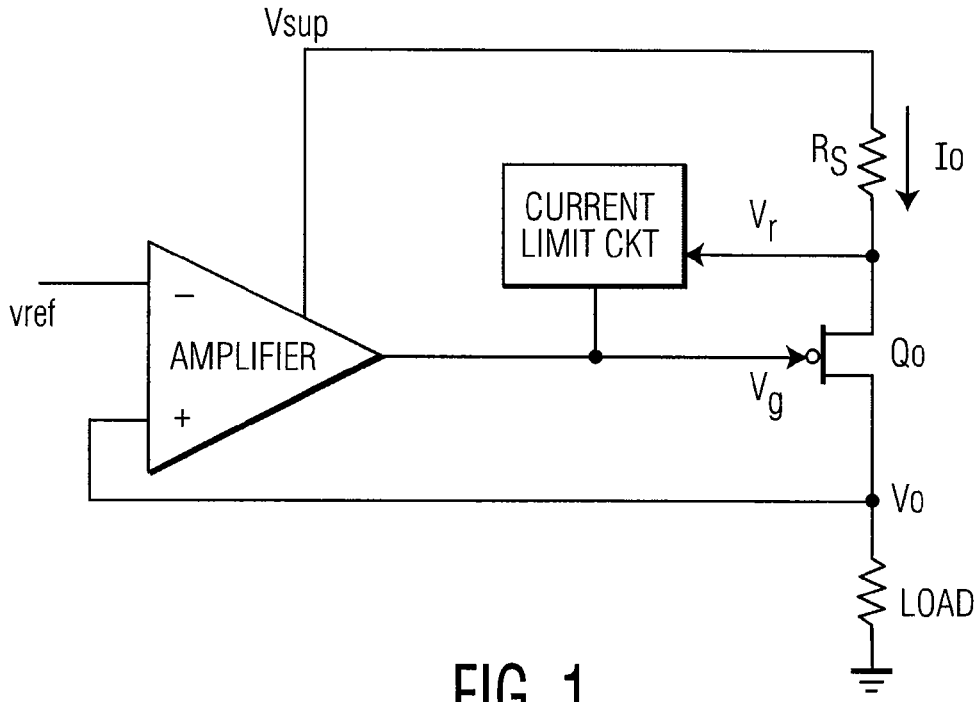
FIG. 1 PRIOR ART
FIG. 1 is a schematic block diagram of a prior art circuit for a low dropout voltage regulator.
Figure 2:
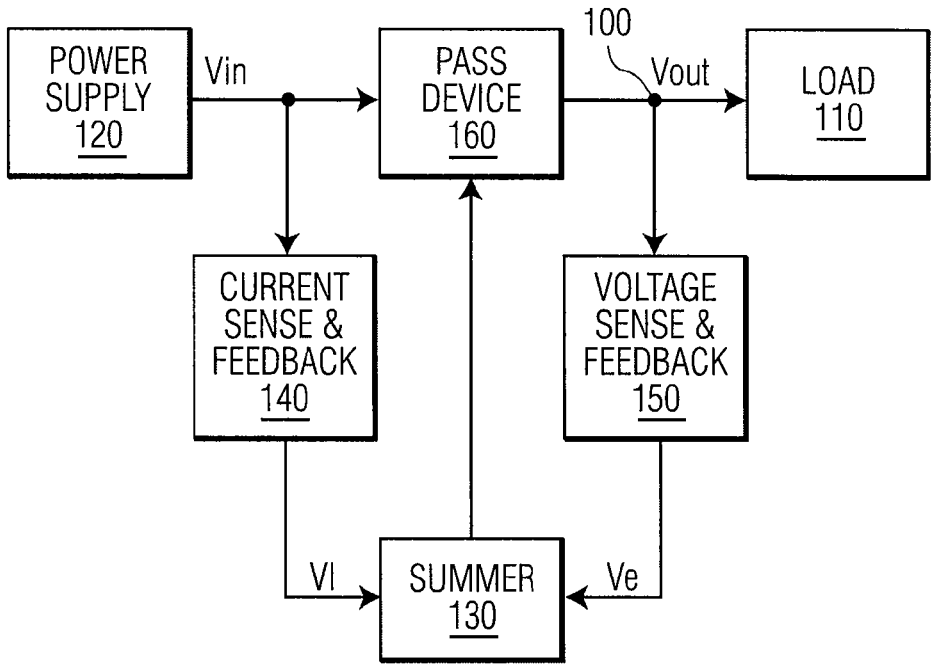
FIG. 2 PRIOR ART
FIG. 2 is a schematic block diagram of another prior art low dropout voltage regulator, including a voltage sensing feedback loop and a current sensing feedback loop.
Figure 3:
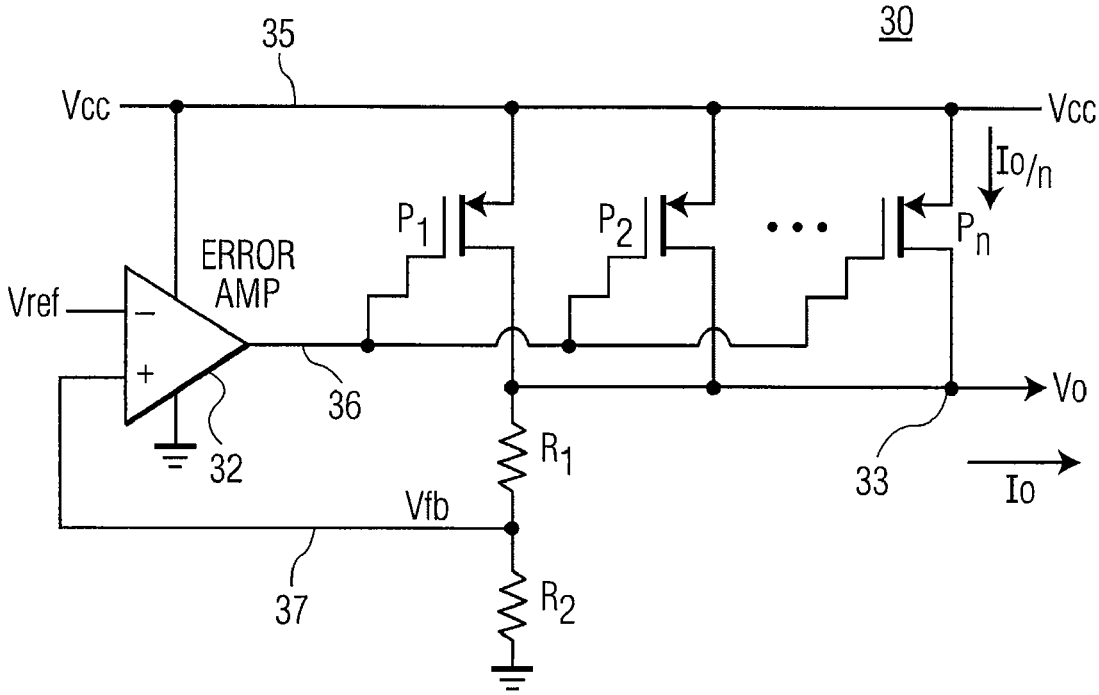
FIG. 3 is a schematic circuit diagram of a low dropout voltage regulator providing a regulated voltage output and a varying load current delivered from multiple PFETs, in accordance with an embodiment of the present invention.

Referring first to FIG. 3, there is shown an LDO regulator, generally designated as 30. As shown, LDO regulator 30 includes a regulated voltage output, $V_o$, and an output current, $I_o$, which may fluctuate based on an output load (not shown). An input voltage, $V_{cc}$, is provided on line 35 and the output voltage, $V_o$, is provided on line 33. A load (similar to load 110 of FIG. 2) may be coupled to line 33 to establish the output voltage, $V_o$, and draw the load current, $I_o$.

The load current, $I_o$, is supplied by multiple PFETs that are connected in parallel. As shown, "n" PFETs are connected in parallel, with the gate of each PFET connected to line 36, the source of each PFET connected to line 35 providing $V_{cc}$, and the drain of each PFET connected to line 33 providing $V_o$. Assuming that the PFETs are similar in size, and each PFET is a current source delivering $I_{o/n}$ amount of current, then line 33 effectively delivers $$\left(\frac{I_o}{n}\right)(n)$$

amount of current, which is $I_o$.

The LDO regulator 30 includes a feedback network comprising resistors $R_1$ and $R_2$. One end of resistor $R_1$ is connected to line 33 providing the regulated voltage output, $V_o$, and one end of resistor $R_2$ is connected to a ground reference. The node connecting resistors $R_1$ and $R_2$ provides a feedback voltage, $V_{fb}$, on line 37. As shown, the feedback network is a resistive voltage divider that generates the feedback voltage, $V_{fb}$.

An error amplifier, generally designated as 32, provides control to LDO regulator 30. The feedback voltage, $V_{fb}$, is provided to the non-inverting input of error amplifier 32 via line 37. A reference voltage, $V_{ref}$, is provided to the inverting input of error amplifier 32. An error signal is provided at the output terminal of error amplifier 32 on line 36, which is connected to the gate terminal of each PFET, namely $P_1$, $P_2$, . . . $P_n$.

Although not shown, it will be appreciated that the reference voltage may be provided by a circuit utilizing a zener diode and low temperature coefficient components. The circuit may also be limited in its current driving capability, so long as a stable, direct current (DC) voltage is generated as the voltage reference, $V_{ref}$.

In addition, LDO regulator 30 may include a fault protection circuit (not shown) to prevent the LDO regulator from burning out, or suffering damage during accidental overload conditions. For example, the input voltage on line 35 may be shut down by the fault protection circuit to protect the circuit.

Further still, LDO regulator 30 may include a current limiting circuit (not shown) to prevent damage due to excessive current flowing on line 33. For example, the current limiting circuit may be configured to sink accidental current overload away from line 33.

The error amplifier 32 and the voltage divider comprising $R_1$ and $R_2$ provide a regulation loop which determines and maintains the output voltage at a level of $V_o$. The output voltage depends on the reference voltage, $V_{ref}$, and the values of $R_1$ and $R_2$. Accordingly, the output voltage $V_o$ is approximately:

$$V_o \approx Vref\left(1 + \frac{R_1}{R_2}\right).$$

Thus, in the embodiment of FIG. 3, the output voltage depends approximately on the reference voltage, $V_{ref}$, and the ratio of $R_1$ to $R_2$.

The LDO regulator may be fabricated on an integrated circuit (IC) chip. Integrated circuit technology allows design of precisely matched component values. Any fabrication process variation affects the values of similar components in the same way. Accordingly, the output voltage of the LDO regulator is stable over variations in input voltage, temperature and fabrication.

Since each PFET ($P_1$, $P_2$, . . . , $P_n$) are matched to each other, each PFET drains an equal amount of current, namely $I_{o/n}$. Since there are "n" PFETs arranged in parallel, line 33 provides the sum of all the drain currents to the output load, namely $I_o$.

During normal operation, all "n" PFETs are conducting an output current, which is the sum of the output load current and the feedback current provided into $R_1$ and $R_2$. Arranging $R_1$ and $R_2$ to receive an insignificant portion of the output current, then the output current is substantially the load current $I_o$.(FIG. 3).

An advantage of LDO regulator 30 is the relatively low input-output differential voltage. The minimum input-output differential voltage (or dropout voltage) defines the minimum voltage level required to sustain a desired output voltage. The relatively low dropout voltage enables the LDO regulator to operate over a wider range of input voltage levels.

The dropout voltage is defined as the difference between the input voltage $V_{cc}$ and the voltage at the load output $V_o$, when $V_o$ is no longer regulated. Stated differentially, $$V_{dropout} = V_{cc} - V_o \text{ at } I_{load}, \text{ when } V_o \text{ is no longer regulated}$$

$$\approx \left(\frac{R_{dson}}{n}\right) I_{load}$$

where n=number of parallel PFETs $I_{load}$=load current for dropout $R_{dson}$=minimum resistance between drain and source when PFET is on.

By minimizing $R_{dson}$ of each PFET in the LDO regulator, the dropout voltage ($V_{dropout}$) may also be minimized. For example, by increasing particular dimensions of each PFET during fabrication, the output resistance ($R_{dson}$) of each PFET may be decreased.

By comparing the reference voltage ($V_{ref}$) and the feedback voltage ($V_{fb}$), error amplifier 32 drives the gates of the PFETs to achieve the desired output voltage, $V_o$, regardless of the load current ($I_o$).

The gate voltage on line 36 is adjusted by the error amplifier to control the output current level of each PFET, namely $I_{o/n}$. The gate voltage is adjusted by the error signal on line 36. The error signal drives the PFETs harder to increase the output current, when the output voltage drops below a desired level. Conversely, the error signal configures the PFETs to decrease the output current, when the output voltage is above a certain level.

Figure 4:
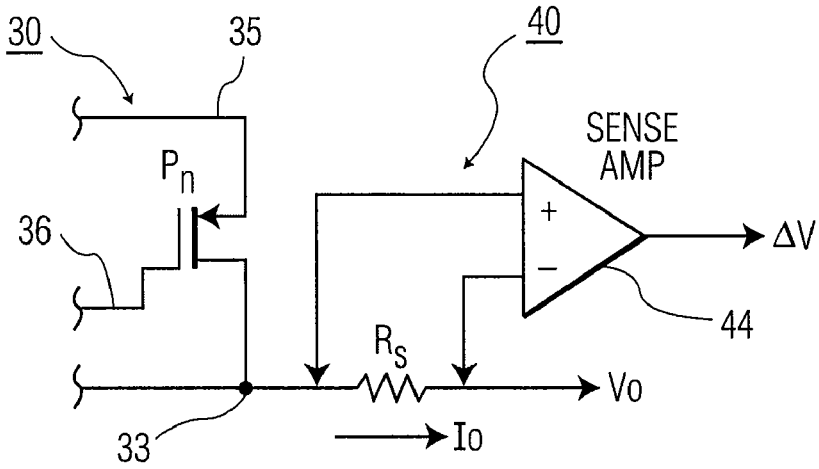
FIG. 4 is a schematic diagram of a sense amplifier and a sense resistor connected to the voltage regulator of FIG. 3.

A disadvantage of LDO regulator 30 is that it includes a sense resistor, $R_s$, in series with line 33, as shown in FIG. 4. Referring now to FIG. 4, the load current, $I_o$, on line 33 of LDO regulator 30 is measured by a load current measurement circuit, generally designated as 40. The load current measurement circuit includes sense resistor $R_s$ and sense amplifier 44. The voltage drop across $R_s$ is sensed by sense amplifier 44 to provide a differential output Δv. Accordingly, $$I_o = \frac{\Delta V}{R_s}$$

It will be appreciated that $R_s$ increases the voltage dropout, $V_{dropout}$, by $$I_o R_s = I_{load} R_s$$

$R_s$ also reduces the load regulation. The sense amplifier requires a low offset between the inverting and non-inverting input terminals. Accordingly, the sense amplifier works with input signals at or near $V_o$, which may be near $V_{cc}$ under low dropout conditions.

Figure 5:
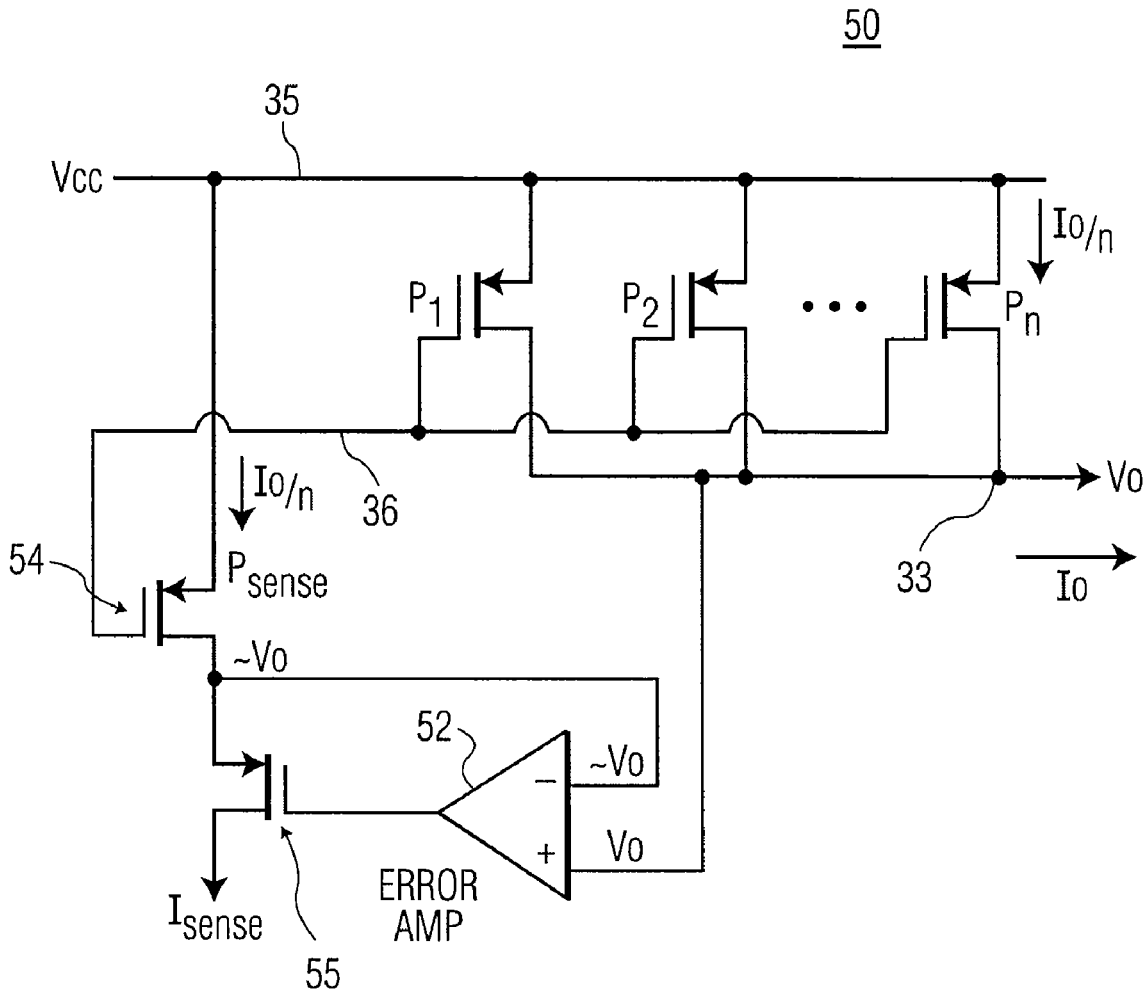
FIG. 5 is yet another low dropout voltage regulator, including a sense PFET coupled to an error amplifier for sensing the load current in the regulated voltage output, without disturbing the output load condition, in accordance with an embodiment of the present invention.

The present invention eliminates load current measurement circuit 40 by providing a different load current measurement circuit, shown as a PFET designated as $P_{sense}$ in FIG. 5. This load current measurement circuit does not suffer the disadvantage of inserting a sense resistor in the output current path (as shown in FIG. 4).

Referring now to FIG. 5, there is shown LDO regulator 50, which includes the same set of multiple PFETs connected in parallel as the set of PFETs of LDO regulator 30. As shown, the "n" PFETs, namely $P_1$, $P_2$, . . . , and $P_n$, are connected to lines 35, 36 and 33, in a manner similar to the connections shown in FIG. 3. An additional PFET, namely $P_{sense}$, is included, however, with its gate connected to line 36, its source connected to line 35 ($V_{cc}$), and its drain connected to the inverting input terminal of error amplifier 52. The drain of the $P_{sense}$ PFET is also connected to the source of PFET 55, as shown.

PFET 55 is a cascode transistor having its gate connected to the output terminal of error amplifier 52 and its drain providing the current sensing output of $I_{sense}$. As will be explained, the drain current of PFET 55 ($I_{sense}$) is equal to the drain current of $P_{sense}$, namely $I_{o/n}$.

The $P_{sense}$ PFET is identical to any one of the $P_1$ to $P_n$ array of PFETs. During fabrication, the $P_{sense}$ PFET is configured to be in close thermal contact with the $P_1$ to $P_n$ array of PFETs. The source of the $P_{sense}$ PFET provides a current of $I_{o/n}$, just like the $P_1$ to $P_n$ array of PFETs. The source of the $P_{sense}$ PFET and the sources of the $P_1$ to $P_n$ array of PFETs are connected to $V_{cc}$, and the gate of the $P_{sense}$ PFET and the gates of the $P_1$ to $P_n$ array of PFETs are connected to line 36. The error amplifier forces the drain of the $P_{sense}$ PFET to approximately be equal to $V_o$, essentially the same as the drains of $P_1$ to $P_n$. In addition, the output error signal from error amplifier 52 is provided to the gate of the $P_{cascode}$ PFET 55.

It will be understood that the $P_{cascode}$ PFET may be any convenient size and does not need to be matched to the $P_1$ to $P_n$ array of PFETs, neither in size nor in thermal characteristics. The error amplifier forces the $P_{cascode}$ PFET to drain $I_{o/n}$, from its source, because $P_{sense}$ has the same terminal voltages as PFET array $P_1$ to $P_n$ and thus conducts the same array current, namely $I_{o/n}$. Furthermore, error amplifier 52 does not need to be as accurate as error amplifier 32 shown in FIG. 3.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. An LDO voltage regulator comprising:

an output terminal for providing a regulated voltage output to a load, a plurality of PFETs connected in parallel, wherein each PFET drains a level of current and the sum of the levels of current are provided as a current output at the output terminal, and all drains of the plurality of PFETs are directly tied together to provide the regulated voltage output to the load, a sensing network, including a sensing PFET, connected to the plurality of PFETs for sensing the level of current drained by each of the plurality of PFETs, wherein the sensing PFET includes a drain, which is not tied to the drains of the plurality of PFETs, and an error amplifier coupled between the output terminal and the sensing network for providing a voltage to the sensing network, wherein a summation of the drains of current from each PFET is provided as the current output to regulate the voltage output at the output terminal, and the sensing network senses the level of current drained by each PFET of the plurality of PFETs, and provides the sensed level of current as an output control signal.

2. The LDO voltage regulator of claim 1 wherein the plurality of PFETs include n PFETs, n being an integer greater than 1.

3. The LDO voltage regulator of claim 2 wherein each of the n PFETs includes a source connected to a primary voltage, a gate connected to all other gates of the n PFETs, and a drain connected to the output terminal.

4. The LDO voltage regulator of claim 2 wherein each PFET drains a current level of $I_0/n$ and the summation of the drains of current is $I_0$.

5. The LDO voltage regulator of claim 2 wherein the sensing PFET is separate from the plurality of PFETs, and the sensing PFET provides the same level of current as each PFET of the plurality of PFETs.

6. The LDO voltage regulator of claim 5 wherein the sensing PFET includes a gate connected to all the gates of the PFETs of the plurality of PFETs, a source connected to a primary voltage and a drain connected to an inverting input terminal of an error amplifier.

7. The LDO voltage regulator of claim 6 wherein a non-inverting input terminal of the error amplifier is connected to the output terminal.

8. The LDO voltage regulator of claim 6 wherein the sensing network includes a cascode PFET having a gate connected to an output terminal of the error amplifier, a source connected to the drain of the sensing PFET, and a drain providing the sensed level of current as the output control signal.

9. The LDO voltage regulator of claim 8 wherein the inverting input terminal of the error amplifier and the drain of the sensing PFET include a voltage level approximately corresponding to the regulated voltage output, and the sensed level of current is approximately a level of current which is the same as a level of current in the drain of each PFET of the plurality of PFETs.

10. The LDO voltage regulator of claim 2 wherein the output current level is $I_0$ and the drain of each PFET of the plurality of PFETs has a current level of $I_0/n$, and the sensed level of current is approximately $I_0/n$.

11. The LDO voltage regulator of claim 2 wherein the sensing network is free-of resistor networks.

12. The LDO voltage regulator of claim 2 wherein the regulated voltage output is provided to digital circuit elements in an integrated circuit, a system on a chip (SOC), or a circuit board.

* * * * *